US008366349B2

(12) United States Patent
Beachner

(10) Patent No.: US 8,366,349 B2
(45) Date of Patent: Feb. 5, 2013

(54) SYSTEM AND METHOD FOR AGGREGATE DISPOSAL

(75) Inventor: Robert Beachner, Erie, KS (US)

(73) Assignee: Beachner Construction Company, Inc., St. Paul, KS (US)

( * ) Notice: Subject to any disclaimer, the term of this patent is extended or adjusted under 35 U.S.C. 154(b) by 98 days.

(21) Appl. No.: 11/937,993

(22) Filed: Nov. 9, 2007

(65) Prior Publication Data

US 2008/0152432 A1 Jun. 26, 2008

Related U.S. Application Data

(60) Provisional application No. 60/858,560, filed on Nov. 13, 2006.

(51) Int. Cl.
*B65G 5/00* (2006.01)

(52) U.S. Cl. ..... 405/129.35; 405/53; 405/129.1

(58) Field of Classification Search ..... 405/53, 405/129.1, 129.2, 129.25, 129.35, 129.4; 588/250

See application file for complete search history.

(56) References Cited

U.S. PATENT DOCUMENTS

| | | | | |
|---|---|---|---|---|
| 3,586,378 | A * | 6/1971 | Dietz | 299/5 |
| 3,803,850 | A * | 4/1974 | Hendrix | 405/53 |
| 4,192,555 | A * | 3/1980 | Willett | 299/4 |
| 6,002,063 | A * | 12/1999 | Bilak et al. | 588/17 |
| 6,149,344 | A * | 11/2000 | Eaton | 405/129.28 |
| 6,929,423 | B2 * | 8/2005 | Kittle | 405/129.95 |
| 7,077,201 | B2 * | 7/2006 | Heins | 166/266 |
| 7,097,386 | B2 * | 8/2006 | Maduell et al. | 405/129.35 |
| 2002/0029574 | A1 * | 3/2002 | Yoshioka | 62/53.1 |
| 2003/0132659 | A1 * | 7/2003 | Pickren | 299/6 |
| 2005/0147472 | A1 * | 7/2005 | Alexander | 405/129.2 |

* cited by examiner

*Primary Examiner* — David Bagnell
*Assistant Examiner* — Benjamin Fiorello
(74) *Attorney, Agent, or Firm* — Lathrop & Gage LLP

(57) ABSTRACT

A system for disposing of aggregate material in a mine cavern between a mine ceiling and a mine floor includes a first pump for pumping water from the cavern, a second pump for pumping emulsion to the cavern, a gated proportioning mechanism, and a water line extending between the first and second pumps and being accessible at the gated proportioning mechanism such that aggregate in the gated proportioning mechanism is introduced into the water line to form the emulsion. The second pump is configured such that the emulsion is pumped into the cavern at a pressure between about 20 pounds per square inch and about 30 pounds per square inch and settles on the mine floor in a pile having an angle of repose between about 1:1.5 and about 1:3.5. The pressure is insufficient to fracture the mine floor and insufficient to fracture the mine ceiling.

13 Claims, 4 Drawing Sheets

SYSTEM AND METHOD FOR AGGREGATE DISPOSAL

CROSS-REFERENCES TO RELATED APPLICATIONS

This application is related to and claims priority from commonly owned U.S. Provisional Patent Application Ser. No. 60/858,560, entitled: System and Method for Aggregate Disposal, filed Nov. 13, 2006, the disclosure of which is incorporated by reference herein.

TECHNICAL FIELD

The disclosed subject matter is directed to systems and methods for waste disposal, and more particularly, to systems and methods for safely disposing of chat and tailings for underground storage.

BACKGROUND

Lead and zinc production involved crushing and grinding the mined rock to standard sizes and separating the ore. The remaining material or by product of this ore separation is known as "chat" or "tailings." While some of the chat or tailings was deposited into the mine shafts once the mines were exhausted or abandoned, most of the chat and tailings were left behind in piles of leftover rock. For example, these "chat" and "tailings" piles cover over 40,000 acres in Cherokee County, Kansas, Ottawa and Craig Counties in Oklahoma, and Jasper County, Missouri, making it some of the most environmentally blighted land in the United States.

These wastes were also a source of contamination. Lead, zinc, and cadmium from the chat and tailings leached into the shallow ground water, contaminating local wells, and runoff moved contaminants into nearby streams and rivers. Wind also blew fine metal-bearing dust (from chat and tailings piles and roads made of chat and tailings) into the air, spreading the contamination to nearby non-mined areas.

It was attempted to dispose of the chat and tailings by depositing it back into the mines. However, the biggest problem faced was that the caverns in the mines were filled with water, that was contaminated. Simply dumping the chat and tailings 10 back down the mine casings (shafts) 12 into the caverns 14, formed between the mine roof 14*a* and the mine floor 14*b*, that either were or over time filled with water, did not spread the chat and tailings 10 in a volume efficient manner. Rather, the chat and tailings accumulated in a conical pile 15, as shown in FIG. 1.

As a result most of the space in the caverns 14, between the mine roof 14*a* and the mine floor 14*b*, was not filled (as shown in FIG. 1). Also, raw chat plugged the casings quickly. The chat was typically not screened for large particles, hindering the dumping process. Moreover, the chat and tailings just dumped into the casing 12 in this manner, as shown in FIG. 1, and eventually returned above the ground surface 16 in the form of toxic dust.

Additionally, the chat and tailings can not be put in large holes and ditches on the ground surface and buried therein, as the rock table is too close to the ground surface. Accordingly, there is simply not enough over burden to facilitate such a process.

With additional reference to the mine cavern 14, the total depth of the mine, from the surface 16 to the mine floor 14*b* is represented by the arrows labeled $D_T$. The depth through the dirt/rock strata 18, from the surface 16 to the mine roof 14*a* is represented by the arrows labeled $D_M$, and the mine cavern height, from roof 14*a* to floor 14*b* is represented by the arrows labeled $H_M$.

SUMMARY

The disclosed subject matter provides systems and methods for returning the materials of chat and tailing piles back underground, and typically back to the caverns of the former mines from which the ores were removed, in a long-term, pollution free and environmentally safe manner. The systems and methods disclosed provide for the movement of large amounts of chat and tailings in a cost effective manner. For example, this allows for the land above the mines to be reclaimed.

The disclosed subject matter is directed to systems and methods for disposing of aggregate material in the mine caverns from which these materials were originally obtained. In an apparatus for combining aggregate material, for example, chat or tailings, with water, an emulsion is formed. The water is drawn from the cavern, through a casing. The emulsion is pumped back into the cavern below ground level, through another casing, the pumping at pressures that overcome the forces of the water in the cavern and create turbulence in the water, such that the emulsion spreads throughout the cavern, at a good angle of repose, to maximize the amount of material disposed of.

The disclosed methods and systems employ separators, to render the chat and tailings, such that they can be blended into a homogeneous material, such as an emulsion, that is pumped under pressure, back into the underground caverns for safe disposal and storage. Additionally, the water used for the methods is the same water presently in the caverns, and therefore, avoids using and contaminating fresh water. These systems and methods also include methods for flowing emulsified chat or tailings, such that it can be deposited into the caverns, so as to flow through the voids, maximizing the amount of material that can be deposited in the caverns.

The disclosed subject matter is directed to a method for disposing of aggregate material. The method includes, obtaining aggregate material, and combining the aggregate material with water to form an emulsion. The emulsion is then pumped into a cavern below ground level at pressures that overcome the forces of the water in the cavern and create turbulence in the water, such that the emulsion spreads throughout the cavern.

There is also disclosed a system for disposing of aggregate material. The system includes an apparatus for combining aggregate material, for example, chat or tailings, with water to form an emulsion, and a pump. The pump acts on the emulsion, to pump it into a cavern below ground level at pressures that overcome the forces of the water in the cavern and create turbulence in the water, such that the emulsion spreads throughout the cavern.

BRIEF DESCRIPTION OF THE DRAWINGS

Attention is now directed to the drawings, where like numerals or characters indicate corresponding or like components. In the drawings.

DETAILED DESCRIPTION

Figure 1:
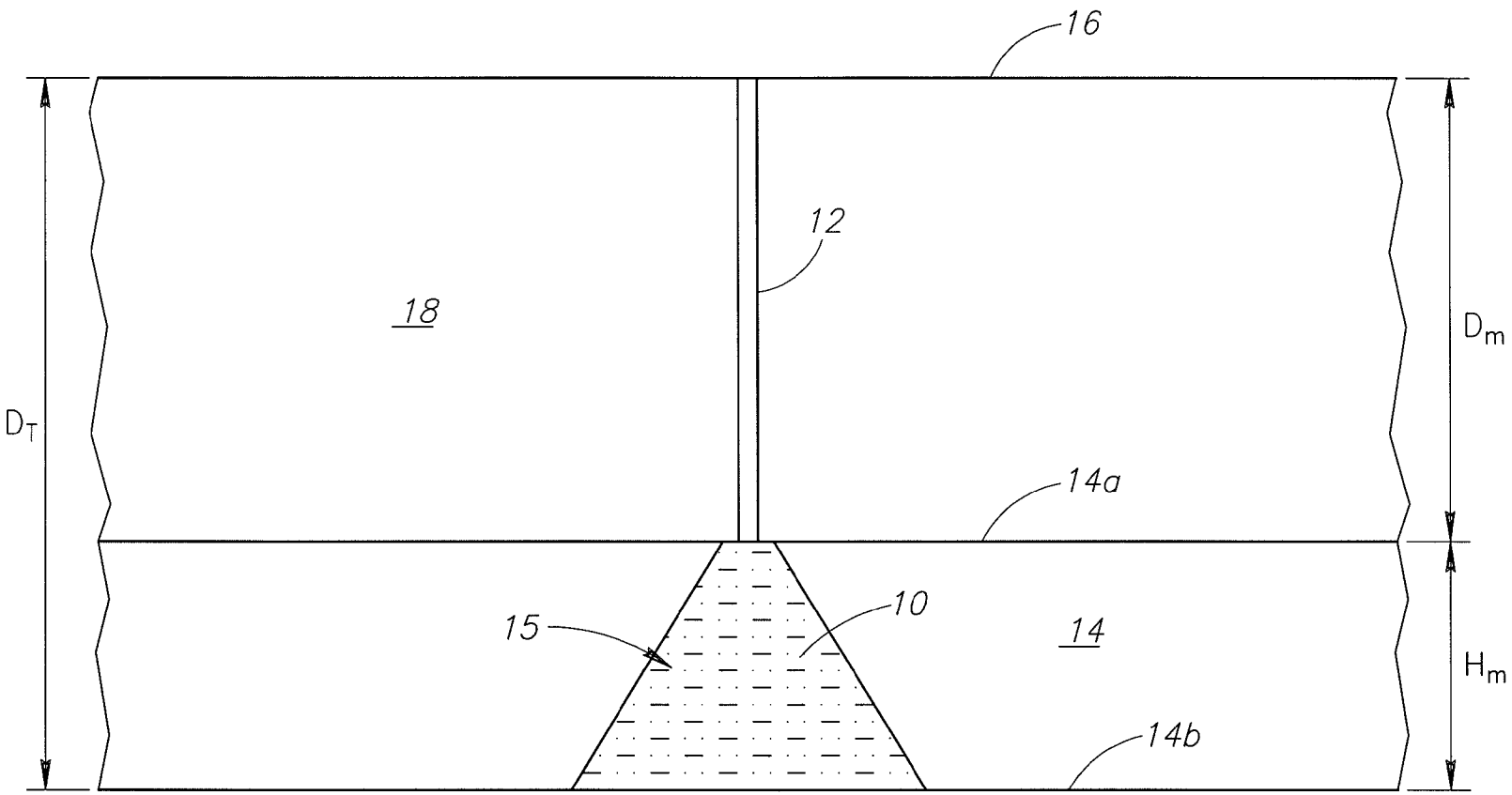
FIG. 1 PRIOR ART
FIG. 1 is a diagram of a mine cavern showing the present storage of chat or tailings.
Figure 2A:
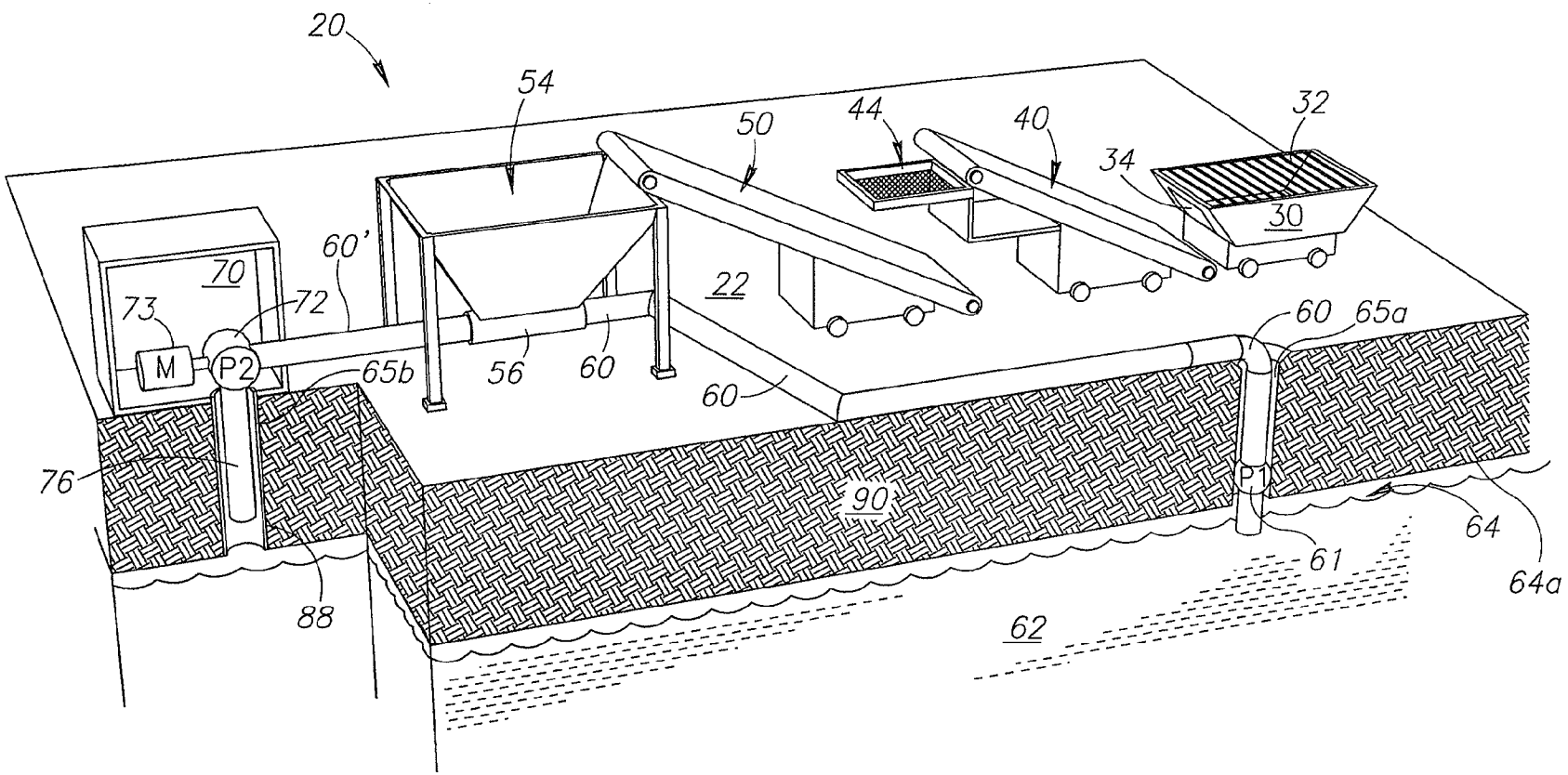
FIG. 2A is a diagram of a system in accordance with the disclosed subject matter.

FIG. 2A shows the disclosed subject matter as a system 20 both above and below the ground surface 22. The system 20 includes multiple components for processing the chat or tailings, emulsifying it, and causing it to flow in such a manner that emulsified material can fill a maximum amount of space in the underground caverns.

The system 20 includes an aggregate bin 30, or other storage container, with scalper bars 32, for the removal of large pieces, such a boulders, roots, and the like from the chat and tailings piles. The bin 30 also includes a gate 34, that when released, opens the bin 30 and allows material to flow onto a first conveyer 40.

The first conveyer 40, is, for example, a standard conveyer belt system, and includes a screening unit 44. The screening unit 44 is, for example, a shaker screen, for example, of an approximately half-inch size, to create material that is suitable to be flowable, for example, in an emulsion or slurry, as detailed below.

There is a second conveyer 50, that receives material from the screening unit 44. The belt of this conveyer 50 typically includes an electronic weighting system. There is a hopper 54, that receives material from the second conveyer 50. The hopper 54 includes a gated proportioning mechanism 56.

A water line 60 runs under the hopper 54 at the gated proportioning mechanism 56 (with an opening into the water line 60 whose size may be set manually), to receive the aggregate. The water line 60 originates in an irrigation or first pump (P1) 61, that is typically submersible, as shown in a water source 62. The water source 62 is, typically underground (through a layer or layers of strata 90, hereinafter "strata layer", such as dirt, rock and the like), and for example, in an underground cavern 64 of the former mine. The water is obtained from the water source 62, as the pump (P1) 61 pumps the water through the water line 60 (for example, an approximately six inch internal diameter pipe), that extends through the casing 65*a* to the gated proportioning mechanism 56. The pump 61 (P1) may be, for example, a 1000 gallon per minute (gpm) deep well irrigation 40 horsepower (hp) pump.

Figure 3:
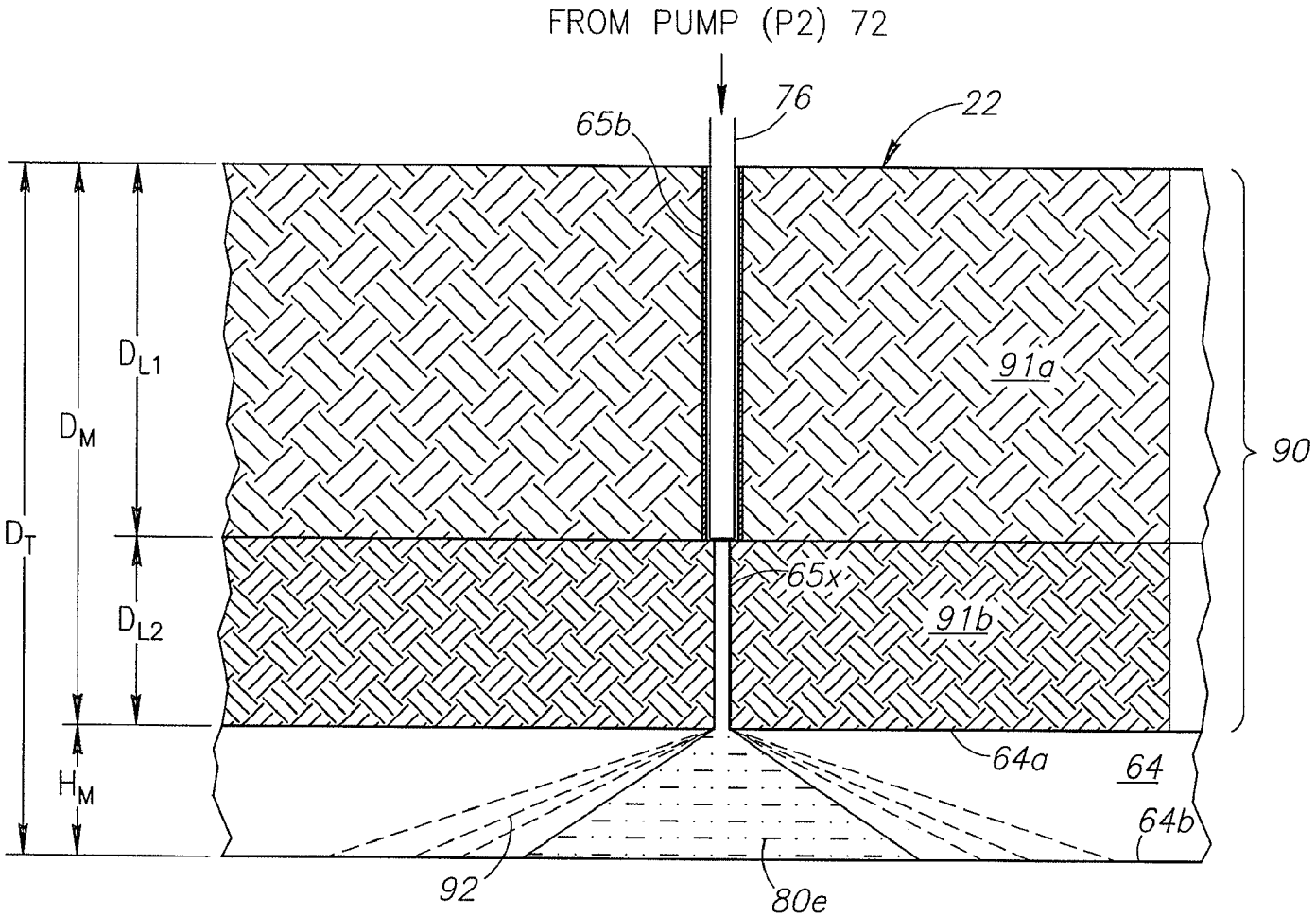

The water line 60' extends from the hopper 54 to a pump unit 70. This pump unit 70 includes a second pump (P2) 72, powered by motor (M) 73. A pipe 76 (for example, 12 inches in internal diameter) extends from the pump (P2) 72, into a mine casing (shaft) 65*b*, for example, typically to depths proximate the last solid layer of rock prior (of the strata 90) to at least proximate the cavern 64. The mine casing 65*b*, is, for example, typically common to the underground cavern(s) 64. The pump (P2) 72 pulls emulsion or slurry (chat or tailings mixed with water) from the grated proportioning mechanism 56 and pushes it down the casing 65*b*, through the pipe 76. There may be a bore hole 65*x* intermediate the casing 65*b* and the cavern 64, depending on the strata, dirt, rock, etc., for example, as shown in FIG. 3. The casing 65*b* alone, and with the bore hole 65*x*, if necessary, form the down hole 88. The second pump (P2) 72 is, for example, a 12" by 10" sand pump, powered by a motor (M) 73, that is, for example, an N-14 400 horsepower diesel engine, available from Cummins Engines. This pump (P2) 72 pumps at pressures from approximately 15-30 pounds per square inch (psi).

Figure 2B:
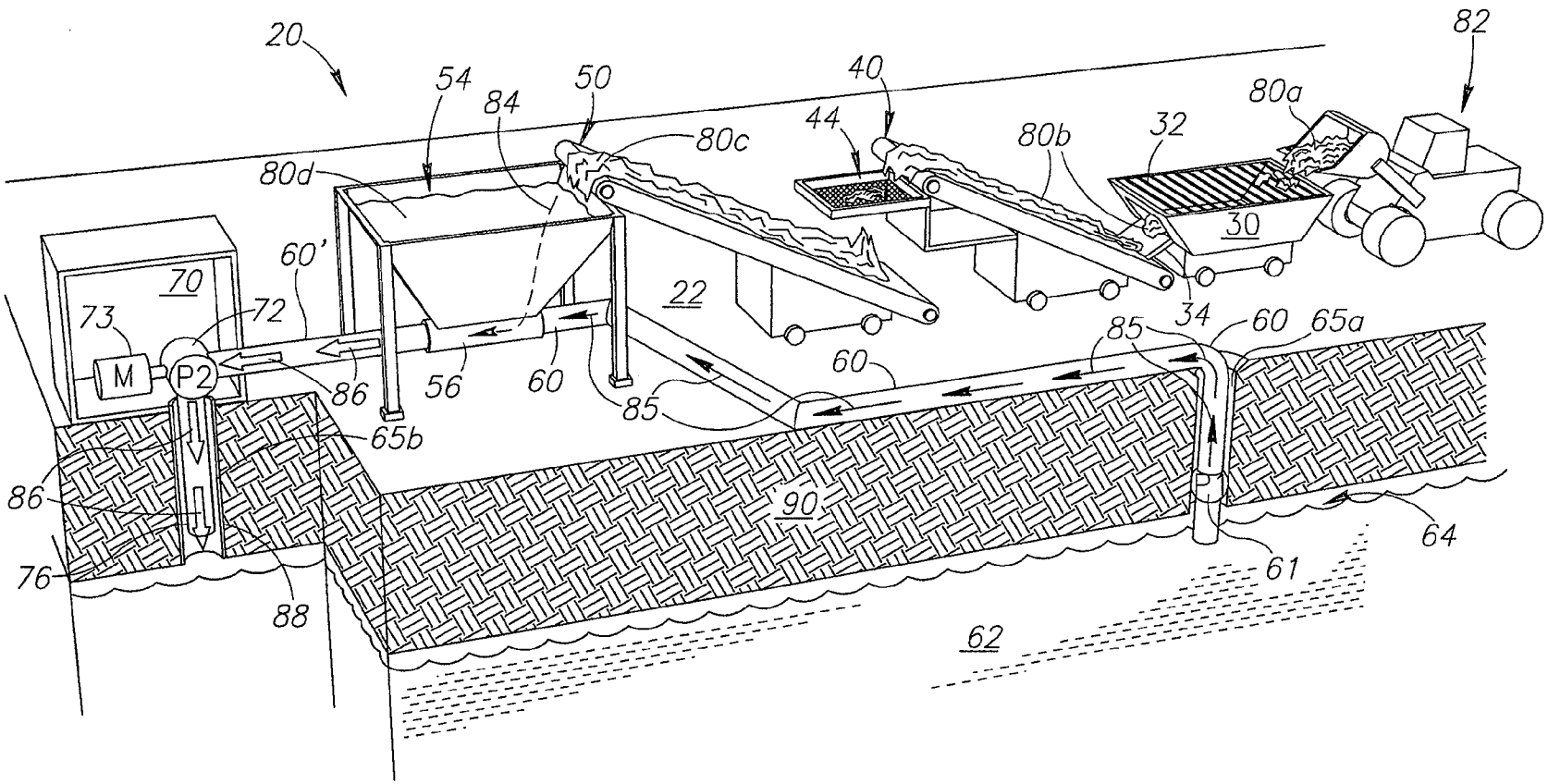
FIG. 2B is a diagram of the system of FIG. 2A, shown in an exemplary operation; and, FIG. 3 is a diagram of a mine showing the results of the exemplary operation of FIG. 2B.

Turning also to FIGS. 2B and 3, an exemplary operation of the system 20 is detailed. Initially, chat or tailings 80, from chat or tailings piles are dumped into the aggregate bin 30, by a loader 82. The chat or tailings 80*a* passes through the scalper bars 32, to remove large materials, such as boulders, tree roots and the like. The gate 34 is opened, such that the sifted chat or tailings is received on the first conveyer 40. The first conveyer 40, delivers the chat or tailings 80*b*, to the screening unit 44, where it is again sorted to be of an approximately half-inch size, to create material that is suitable to be flowable. The now sorted chat or tailings 80*c* is received on a second conveyer 50, that delivers it to the hopper 54.

The chat or tailings 80*d* (also known as aggregate) flows downward, by gravity to the gated proportioning mechanism 56, where it enters the water line 60 (as shown by the broken line bent arrow 84). The water for the water line 60 is delivered from the pump (P1) 61, that moves the water in the direction of the thin arrows 85. The aggregate 80*d* combines with the water in the water line 60, as the aggregate 80*d* flows into the water at speeds sufficient to create an emulsion or slurry 80*e* (the speed in which the aggregate flows to combine with the water is based on the speed of the second conveyer 50—the speed of the conveyer 50 also influenced by the air temperature and other atmospheric conditions, and the size of the opening of the gated proportioning mechanism 56). The emulsion or slurry 80*e* flows along a path indicated by the thick arrows 86.

The pressure from the water (first) pump (P1) 61, coupled with the suction from the second pump (P2) 72 moves the emulsion or slurry 80*e* (in the water line 60') into the second pump (P2) 72. The second pump 72 (P2) pumps the emulsion 80*e*, for example, into the pipe 76 for delivery to the mine cavern 64. The pumping is at pressures of up to 30 psi, and, for example, at pressures of at least approximately 20 psi, in order to overcome the resistance of the water in the cavern 64 (any resistance from any ground water in the down hole 88 is negligible).

Turning also to FIG. 3, the action of the pump (P2) 72 is such that it forces the emulsion or slurry to move at a relative high velocity, for example, approximately 80-140 tons of chat or tailings per hour. This speed of movement causes a spreading action of the emulsion 80*e* as it enters the cavern 64. The spreading action, resulting from the high pumping speeds, also creates turbulence in the water of the cavern 64, allowing for further spreading of the emulsion 80*e*. The complete spreading action is shown by the broken lines 92, and is such that the emulsion 80*e* is completely spread over the maximum volume of the cavern 64, at a good angle of repose, for example, a 1:1.5 to 1:3.5 (34° to 16°) slope on the sides, or less.

Example 1

A system in accordance with FIGS. 2A and 2B was built on 170 acres of mined land on the West edge of Commerce Okla. FIG. 3 shows a land profile, representative of the mined land of the aforementioned site. As shown in FIG. 3, the mined land had a water level, approximately 12-20 feet below the ground surface 22. The total depth of the mine ($D_T$) was approximately 180 to 235 feet. The depth to the mine cavern ($D_M$) 64 was approximately 150 to 195 feet. The height of the mine cavern ($H_M$) 64 was approximately 30 to 40 feet. The depth of the dirt/rock strata layer(s) 91*a* ($D_{L1}$), formed of dirt and shale, was approximately 100 to 120 feet, and the depth of the rock strata layer(s) 91*b* ($D_{L2}$), formed of solid rock, for example, bedrock, was approximately 150 to 195 feet. The cavern 64 was full of water.

A casing 65*b* was made (drilled) to accommodate a 12 inch internal diameter pipe 76, that extended from the pump (P2) 72, through the dirt and shale portion 91*a*, as was an approximately 11 inch bore hole 65*x* continuing from the dirt and shale portion 91*a* through the solid rock portion 91*b* to the cavern. The pipe 76 was extended to the rock portion 91*b* of the strata layer 90.

The irrigation pump (PI) 61 pumped water at approximately 1000 gallons per minute and combined with the aggregate delivered through the hopper 54. The second pump (P2) 72 pumped at pressures averaging at least 20 psi. The resultant emulsion 80*e* was delivered at a relative high velocity, for example, approximately 120 tons of chat or tailings per hour, to the mine cavern 64 (also filled with water), between the mine ceiling 64*a* and mine floor 64*b*. The deposited emulsion 80*e* settled at an angle of repose having a slope of approximately 1:3.

While the system 20 has been shown and described for chat or tailings, for example, from zinc or lead, this is exemplary only. The system 20 and methods for its use can also be used with other mined aggregates, or other aggregates, such a coal, dirt (e.g., contaminated soil) and the like.

While preferred embodiments have been described, so as to enable one of skill in the art to practice the disclosed subject matter, the preceding description is intended to be exemplary only. It should not be used to limit the scope of the disclosed subject matter, which should be determined by reference to the following claims.

What is claimed is:

1. A method for disposing of aggregate material in a mine cavern between a mine ceiling and a mine floor, the method comprising:

obtaining aggregate material having at least one element selected from the group consisting of zinc and lead;

combining the aggregate material with water to form an emulsion; and pumping the emulsion below ground level into the cavern at pressure that overcomes forces of water in the cavern, such that the emulsion settles on the mine floor in a pile having an angle of repose between about 1:1.5 to about 1:3.5, the pressure being insufficient to fracture the mine floor and insufficient to fracture the mine ceiling.

2. The method of claim 1, additionally comprising sorting the aggregate material to an approximately 0.5 inch or less size, before combining the aggregate with water.

3. The method of claim 1, wherein the aggregate material is combined with water pumped from the cavern to form the emulsion.

4. The method of claim 3, wherein the water is pumped from the cavern at approximately 1000 gallons per minute.

5. The method of claim 1, wherein the emulsion is pumped into the cavern at a pressure between about 20 pounds per square inch and about 30 pounds per square inch.

6. The method of claim 5, wherein the emulsion is pumped such that between about 1920 tons of aggregate material and about 3360 tons of aggregate material enter the cavern in a day.

7. The method of claim 6, wherein the aggregate material is combined with water pumped from the cavern to form the emulsion.

8. The method of claim 6, wherein the emulsion is pumped into the cavern at a rate of about 120 tons of aggregate material per hour.

9. A system for disposing of aggregate material in a mine cavern between a mine ceiling and a mine floor, the system comprising:

a first pump for pumping water from the cavern;

a second pump for pumping emulsion to the cavern;

a gated proportioning mechanism; and a water line extending between the first and second pumps and being accessible at the gated proportioning mechanism such that aggregate in the gated proportioning mechanism is introduced into the water line to form the emulsion;

wherein the second pump is configured such that the emulsion is pumped into the cavern at a pressure between about 20 pounds per square inch and about 30 pounds per square inch and settles on the mine floor in a pile having an angle of repose between about 1:1.5 and about 1:3.5, the pressure being insufficient to fracture the mine floor and insufficient to fracture the mine ceiling.

10. The system of claim 9, wherein the second pump is configured such that the emulsion is pumped into the cavern at a rate of between about 80 tons of aggregate material per hour and about 140 tons of aggregate material per hour.

11. The system of claim 10, wherein the first pump is configured such that water from the cavern is pumped at about 1000 gallons per minute.

12. A system for practicing a method of disposing aggregate material in a mine cavern between a mine ceiling and a mine floor such that the aggregate material settles on the mine floor in a pile having an angle of repose between about 1:1.5 to about 1:3.5, the system comprising:

a first pump for pumping water from the cavern;

a second pump for pumping emulsion to the cavern;

a water line extending between the first and second pumps; and a gated proportioning mechanism through which the aggregate is introduced into the line to form the emulsion with the water from the cavern;

wherein the second pump is configured such that the emulsion is pumped into the cavern at a rate between about 80 tons of aggregate material per hour and about 140 tons of aggregate material per hour and at a pressure between about 20 pounds per square inch and about 30 pounds per square inch and settles on the mine floor in a pile having an angle of repose between about 1:1.5 and about 1:3.5, the pressure being insufficient to fracture the mine floor and insufficient to fracture the mine ceiling.

13. The system of claim 12, wherein the first pump is configured such that water from the cavern is pumped at about 1000 gallons per minute.

* * * * *